US007748557B2

(12) United States Patent
Robinson

(10) Patent No.: US 7,748,557 B2
(45) Date of Patent: Jul. 6, 2010

(54) METHOD AND APPARATUS FOR ENHANCING THE SENSORY EXPERIENCE OF CONSUMING A BEVERAGE

(76) Inventor: Mark Roger Robinson, 3065 Cambridge Rd., Cameron Park, CA (US) 95682-9186

( * ) Notice: Subject to any disclaimer, the term of this patent is extended or adjusted under 35 U.S.C. 154(b) by 290 days.

(21) Appl. No.: 11/865,809

(22) Filed: Oct. 2, 2007

(65) Prior Publication Data

US 2008/0083754 A1 Apr. 10, 2008

Related U.S. Application Data

(60) Provisional application No. 60/827,809, filed on Oct. 2, 2006.

(51) Int. Cl.
*B65D 17/34* (2006.01)
*B65D 85/00* (2006.01)

(52) U.S. Cl. ..... 220/269; 220/906; 206/459.5

(58) Field of Classification Search ..... 220/269, 220/270, 908; 40/310, 306; 206/459.5
See application file for complete search history.

(56) References Cited

U.S. PATENT DOCUMENTS

| | | | |
|---|---|---|---|
| 3,805,991 | A | 4/1974 | Cheladze |
| 3,958,717 | A | 5/1976 | Ellis |
| 4,074,827 | A | 2/1978 | Labe, III |
| 4,333,582 | A | 6/1982 | Bloeck et al. |
| 4,619,372 | A | 10/1986 | McFarland |
| 4,953,743 | A | 9/1990 | Dart et al. |
| 5,131,555 | A | 7/1992 | DeMars et al. |
| 5,285,919 | A | 2/1994 | Recchia |
| 5,346,095 | A | 9/1994 | Deal |
| 5,397,014 | A | 3/1995 | Aydt |
| 5,405,039 | A | 4/1995 | Komura |
| 5,635,229 | A | 6/1997 | Ray |
| 5,683,006 | A | 11/1997 | Cook, III |
| 5,819,973 | A | 10/1998 | Traub, Sr. et al. |
| 5,868,272 | A | 2/1999 | Deal |
| 6,076,450 | A | 6/2000 | DiGiorgio, Jr. |
| 6,102,224 | A | 8/2000 | Sun et al. |
| 6,112,932 | A | 9/2000 | Holdren |
| 6,311,863 | B1 | 11/2001 | Fleming |
| 6,561,376 | B2 | 5/2003 | Price et al. |
| 6,578,726 | B1 | 6/2003 | Schaefer |
| 6,648,169 | B1 | 11/2003 | Berger |
| 6,659,833 | B1 | 12/2003 | Sloot |
| 6,817,202 | B1 | 11/2004 | Anthony |
| 6,854,947 | B2 | 2/2005 | Lee |
| 6,880,713 | B2 | 4/2005 | Holley, Jr. |
| 6,981,608 | B2 | 1/2006 | Battmer |
| 6,991,128 | B1 | 1/2006 | Russo et al. |
| 7,073,678 | B1 | 7/2006 | Dibdin et al. |

*Primary Examiner*—Robin Hylton
(74) *Attorney, Agent, or Firm*—John P. O'Banion

(57) ABSTRACT

A beverage container having multiple openings for enhancing the enjoyment of a beverage is disclosed. The container has openings for drinking or emptying a beverage or liquid, in addition to openings designed for experiencing the aroma of a contained beverage. A modified pull-tab is present for manipulating the drink and aroma openings without bending or otherwise deforming. The container can take the form of a one-use container or a refillable, travel-type container having a removable cover.

13 Claims, 7 Drawing Sheets

METHOD AND APPARATUS FOR ENHANCING THE SENSORY EXPERIENCE OF CONSUMING A BEVERAGE

CROSS-REFERENCE TO RELATED APPLICATIONS

This application claims priority from U.S. provisional application Ser. No. 60/827,809, filed on Oct. 2, 2006, incorporated herein by reference in its entirety.

This application is related to Disclosure Document No. 602423, entitled "The AROMA-Can", received by the USPTO on Jun. 20, 2006, incorporated herein by reference in its entirety.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. §1.14.

BACKGROUND OF THE INVENTION

1. Field of the Invention

This invention pertains generally to beverage containers, and more particularly to beverage containers designed to enhance the sensory experience of enjoying a beverage.

2. Description of Related Art

The smell, or aroma, of a beverage is often the aspect that first tantalizes and engages. Allegedly, the taste is the payoff. However, the sense of taste is closely linked to the sense of smell. The aroma, with respect to coffee or wine, for example, has enjoyed vast importance in the sale of such beverages. Carbonated beverages, such as soda or beer, tickle the nose.

The beverage industry has developed various alternatives for users who wish to carry beverages with them when they travel. Bottles of water are now regularly carried about, and bottles and cans of various beverages are available. With respect to carbonated beverages, it is widely believed that fountain beverages are more enjoyable than canned or bottled beverages.

BRIEF SUMMARY OF THE INVENTION

The present invention is preferably embodied in a beverage container having a combination of drinking openings and aroma openings and an improved pull-tab.

An aspect of the invention is a beverage container, comprising: a plurality of scorelines on an end of the beverage container; wherein the scorelines outline a plurality of closed passages through the end; and a tab adjacent to and mounted above the scorelines; wherein the tab is manipulated to open the plurality of closed passages at the scorelines.

One mode of this aspect further comprises a spill resistance indicator oriented between the ends of the container; wherein the spill resistance indicator is parallel to a long axis of the container.

Another mode of this aspect further comprises a plurality of raised ridges about an outer perimeter of the scorelines.

In another mode of this aspect, the plurality of passages through the end is oriented in a cloverleaf pattern.

In another mode of this aspect, the scorelines define a heart-shaped contour for each passage.

In another mode of this aspect, the scorelines define a cloverleaf-shaped contour for each passage.

In another mode of this aspect, the scorelines outline three passages. In an embodiment of this mode, a middle passage is located between two side passages; and each side passage is located about 105°-115° from the middle passage.

In another mode of this aspect, manipulation of the tab to open the plurality of closed passages creates a baffle inside the container and the baffle limits lateral movement of liquid inside the container.

Another mode of this aspect, further comprises a guide region adjacent each of the passages at the scorelines and under the tab; wherein the tab comprises a raised portion; wherein the raised portion is oriented toward the end of the container; and wherein the raised portion registers with the guide region. In one embodiment of this mode, each guide region comprises a ridge having a gap.

In another mode of this aspect, the tab comprises a customizable design portion.

In another mode of this aspect, the tab covers no more than approximately ten percent of an area encompassed by each passage.

Another aspect of the invention is a beverage container, comprising: a plurality of passages passing through an end of the beverage container; and engagement means adjacent to the passages; wherein the engagement means are manipulated to open or close each of the plurality of passages.

One mode of this aspect further comprises a spill resistance indicator located on the container.

In another mode of this aspect, the engagement means comprises a slidable portion.

In another mode of this aspect, the engagement means comprises a pressure activated portion.

In another mode of this aspect, the end having the plurality of passages is a removable cover.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Referring more specifically to the drawings, for illustrative purposes the present invention is embodied in the apparatus generally shown in FIG. 1 through FIG. 14. It will be appreciated that the apparatus may vary as to configuration and as to details of the parts, and that the method may vary as to the specific steps and sequence, without departing from the basic concepts as disclosed herein.

Figure 1:
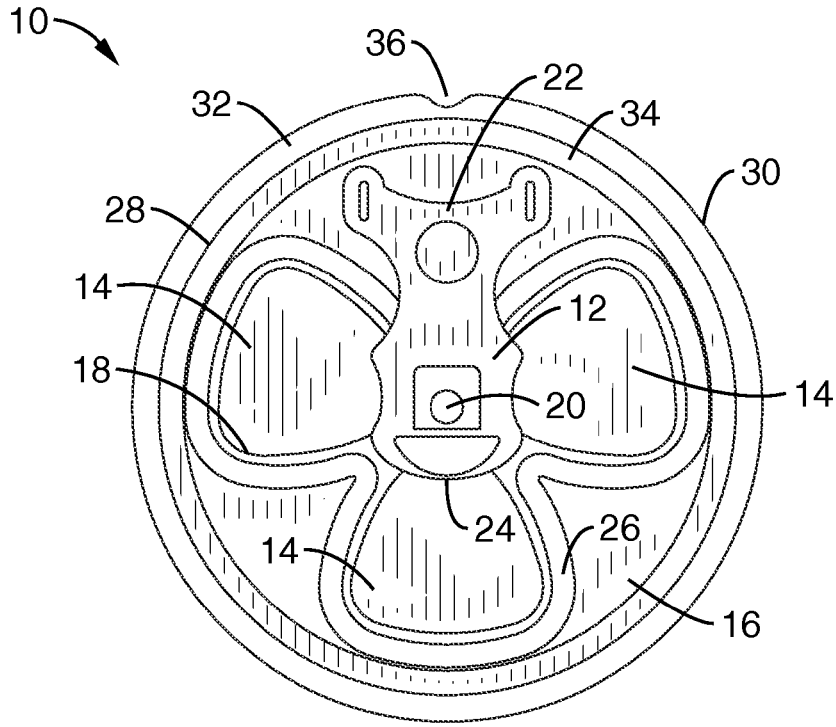
FIG. 1 is a top view of a container according to an embodiment of the present invention.

The top of the container 10 according to an embodiment of the present invention is shown in FIG. 1. In its essence, the container 10 has a pull-tab 12 and three leaves 14 that form openings when forced downwardly by the pull-tab 12 and detached from the top surface 16 at leaf edges (scorelines) 18. The pull-tab 12 is secured by a substantially centrally-located rivet 20, and has a finger-pull 22 at one end and a pry region 24 at the other end. A ridge 26 preferably surrounds the leaves 14 to provide structural stability and improve the aesthetic appearance.

The circumference of the top rim 28 of the container 10 is smaller than the circumference of the exterior surface of the container body 30, and thus, the container exhibits an upper taper 32 from the body edge 30 to the top rim 28. A gutter 34 is present on the top of the container 10, circumscribing the inner boundary of the top rim 28. A spill resistance indicator 36 is located along the outer surface of the body of the container 10.

Figure 2:
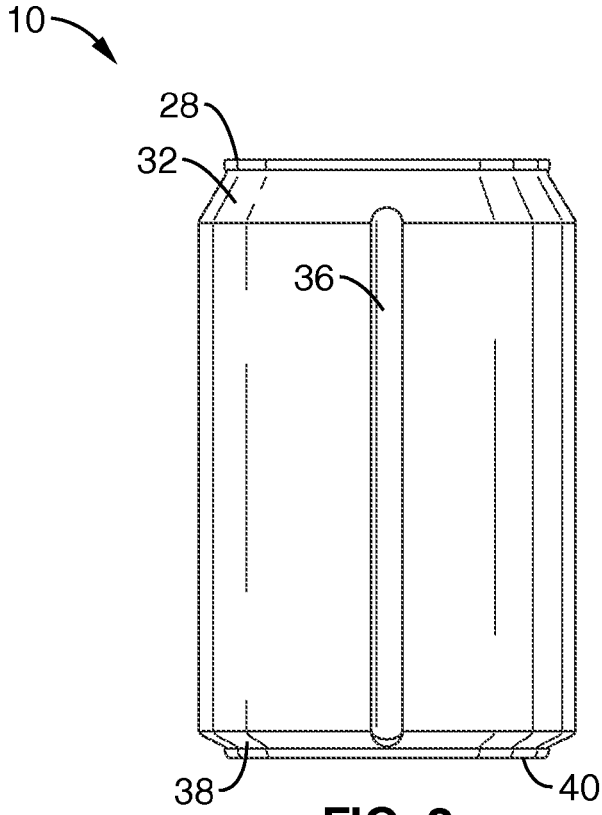
FIG. 2 is a side view of a container according to an embodiment of the present invention, showing the spill resistance indicator.

Referring to FIG. 2, in this embodiment, the spill resistance indicator 36 runs along the long axis of the container 20, in the area between the upper taper 32 and the lower taper 38. The lower taper runs from the body edge 30 to the bottom rim 40. The circumference of the bottom rim 40 is sized to allow stacking of like-sized containers, with the bottom rim 40 of one container nesting in the gutter 34 of another container. The finger-pull 22 does not extend into the gutter 34, and does not interfere with the stacking of containers.

Figure 3:
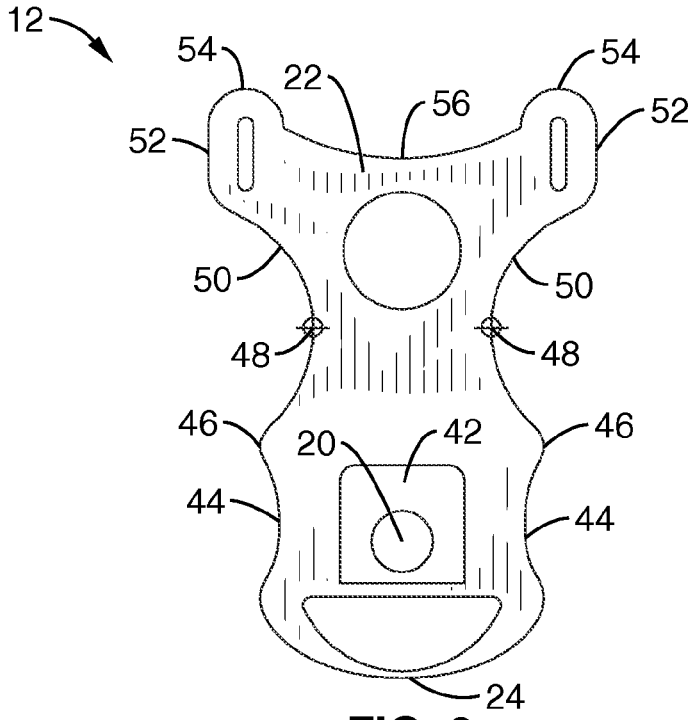
FIG. 3 is a top view of an embodiment of a pull-tab.
Figure 4:
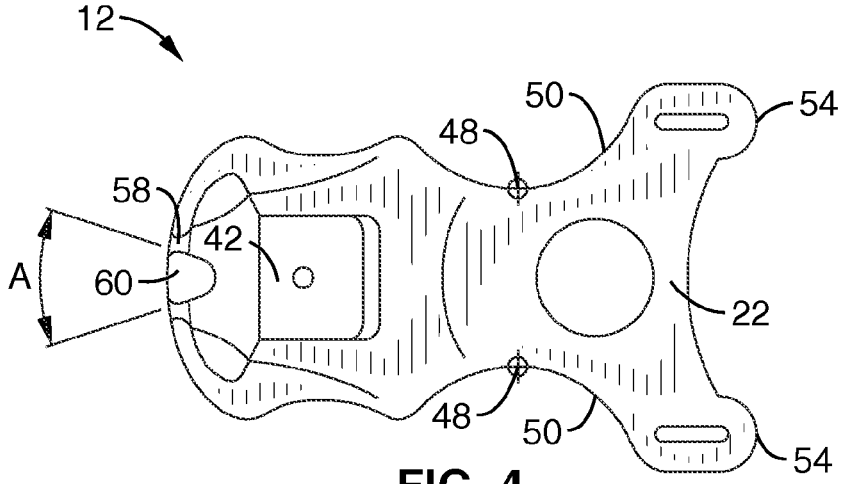
FIG. 4 is a bottom view of another embodiment of a pull-tab.
Figure 5:
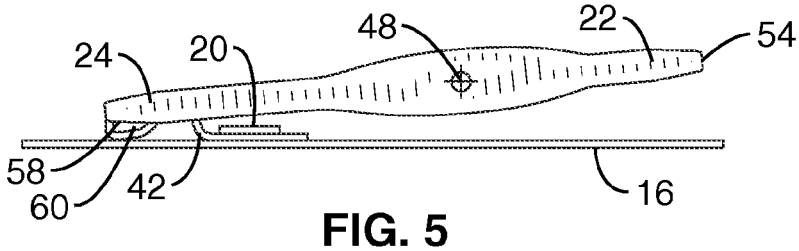
FIG. 5 is a side view of the pull-tab shown in FIG. 4.

Preferred embodiments of the pull-tab 12 are shown in FIGS. 3-5. The pull-tab 12 of the present invention is designed to be ergonomic, reliable, and user friendly. The pull-tab 12 is longer than prior art tabs and preferably has a slender shape and various contours to enhance both comfort and use.

The end of the pull-tab 12 that contacts the leaves 14 is the pry region 24, which is preferably rounded, and it is used to pry open each leaf 14 of the container 10 by lifting at the finger-pull 22 and forcing the pry region 24 downward into each leaf 14, breaking the surface at each leaf edge (scoreline) 18, and then applying further pressure to bend each leaf 14 into the interior of the container 10.

The pull-tab 14 is preferably symmetrical along its long axis, and is attached to the container 10, through an attachment region 42, by a rivet 20 that is substantially centrally located on the top surface of the container 10. In a preferred embodiment, the pull-tab 12 pivots about the rivet 20.

The pry region 24 is preferably a rounded end, with or without a slightly flattened area at the end of the pull-tab 12. The entire pry region 24 is sufficiently wide, relative to the leaves 14, to provide enough downward force to open the leaves 14 without breaking or significantly bending or deforming. The edge of the pull-tab 12 curves about from the pry region 24 and forms a first concave arc 44. This first concave arc 44 is preferably a shallow arc, as shown in FIGS. 3-4. The edge continues outwardly from the arc to form a first shoulder 46. At the first shoulder 46, the width of the pull-tab 12 is preferably approximately the same as the maximum width of the pry region 24.

From the first shoulder 46, the edge curves inwardly to form a second concave arc 48, which is preferably less shallow than the first concave arc 44. The second tapered arc 48 also forms an ergonomic finger-rest 50, which is used to pivot the pull-tab 12 about the rivet 20 when opening the leaves 14 of the container 10. The edge then curves outwardly again to form a second shoulder 52. At the second shoulder 52, the pull-tab 12 is preferably wider than at the first shoulder 46. The edge then curves around to form a rounded tip 54, and the edges from both sides meet to preferably form a third concave arc 56 at the end of the pull-tab 12 having the finger-pull 22. The rounded tips 54 represent the longest outward point of the pull-tab 12, and do not extend into the gutter 34. The third concave arc 56 allows for easy finger ingress when opening the container 10. Because this embodiment of the pull-tab 12 is symmetric with respect to its long axis, it is understood that each of the described features appears on either side of the long axis, as shown in FIG. 3.

The pull-tab 12 must be sturdy enough to force open the leaves 14 without breaking or significantly bending or deforming. The outer edges of the pull-tab are preferably smooth or rolled for safety. The underside of the finger-pull 22 also exhibits a smooth, or non-sharp and non-prickly, and preferably curved, profile for safety. Although the pull-tab 12 can be made of sheet-formed aluminum, using die-cast aluminum results in a pull-tab that is more expensive, but of better quality. Other processes can be used to enhance strength, resilience, aesthetic value, or any combination thereof.

The underside of an embodiment of a pull-tab 12 is shown in FIG. 4. In this embodiment, the pry region 24 has a reinforced section 58, which provides added strength and aids in opening the leaves 14. Also present is a locator tab 60, substantially centered on the reinforced section 58. The locator tab 60 protrudes from the bottom of the pull-tab 12 and registers with structures on the leaves 14, which are described below. This registration allows the locator tab to be precisely placed for correctly and efficiently opening the container 10. The locator tab 60 preferably exhibits an angle A, and is of a size to maximize contact with the leaves 14. Preferably, angle A measures approximately 35°.

FIG. 5 is a side view of the pull-tab shown in FIG. 4, attached to the top surface 16 of the container 10 by a rivet 20. The rivet 20 is secured through an attachment region 42 to the top surface 16. The pull-tab 12 is attached such that its lowest unattached point is the locator tab 60, which is almost in contact with the top surface 16, preferably exhibits greater thickness on the top and underside in the section having the second concave arc 48, and tapers at the two ends (in the section having the rounded tips 54 and in the pry region 24). The finger-pull 22 is then further from the top surface 16 than the pry region 24 or the locator tab 60, and is angled relative to the top surface 16. The increased thickness of the underside of the pull-tab 12 contributes to the angle exhibited by the pull-tab 12. The position and orientation of the finger-pull 22, as well as the tapering of the entire finger-pull end, allows a finger to be easily inserted to open the leaves 14. The section of greater thickness allows the exertion of greater force on the pull-tab 12 during manipulation without damaging or deforming the pull-tab 12.

Figure 6:
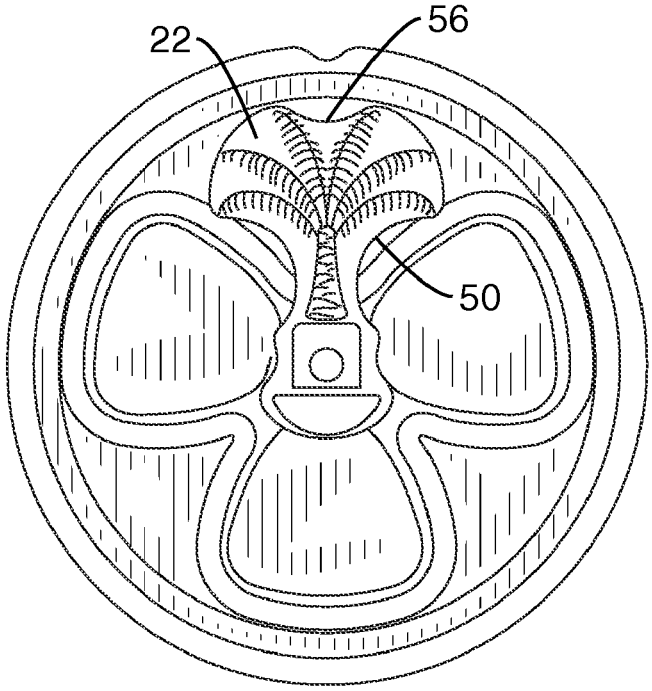
FIG. 6 is a top view of a container according to an embodiment of a present invention, which has another alternative embodiment of a pull-tab.

A container 10 having another embodiment of a pull-tab 12 is shown in FIG. 6. This pull-tab 12 exhibits the same contours as the embodiment shown in FIGS. 3-5, but can also include custom designs or images on the surface of the pull-tab 12 without departing from the present invention. It will be appreciated that a multitude of pull-tab 12 embodiments are contemplated with respect to the present invention, having various shapes and embellishments. For example, in one embodiment, the pull-tab 12 is substantially X-shaped and does not pivot about the rivet 20. In this embodiment, the tab is pulled up from the various ends of the "X" to press open each leaf 14.

Figure 7:
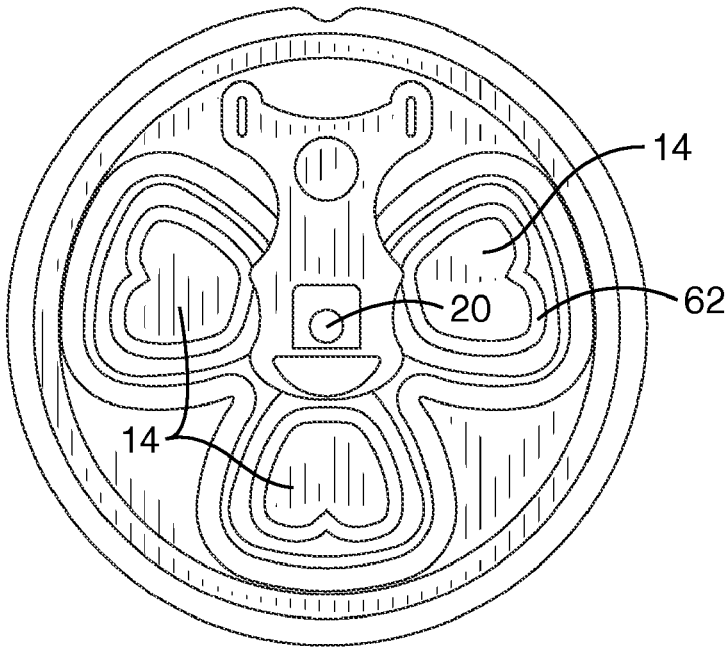
FIG. 7 is a top view of a container according to an embodiment of the invention.

Various embodiments of the container 10 are shown in FIGS. 7-10, with attention to the leaves 14. As shown in FIG. 7, three leaves 14 are disposed about a substantially central rivet 20, preferably in an orientation similar to the leaves of a three-leaf clover or the blades in a fan. The leaves 14 may have raised textures 62 for added rigidity; the raised textures 62 may also be aesthetically appealing or shaped for particular meaning or design (e.g., heart-shaped or similar).

Figure 8:
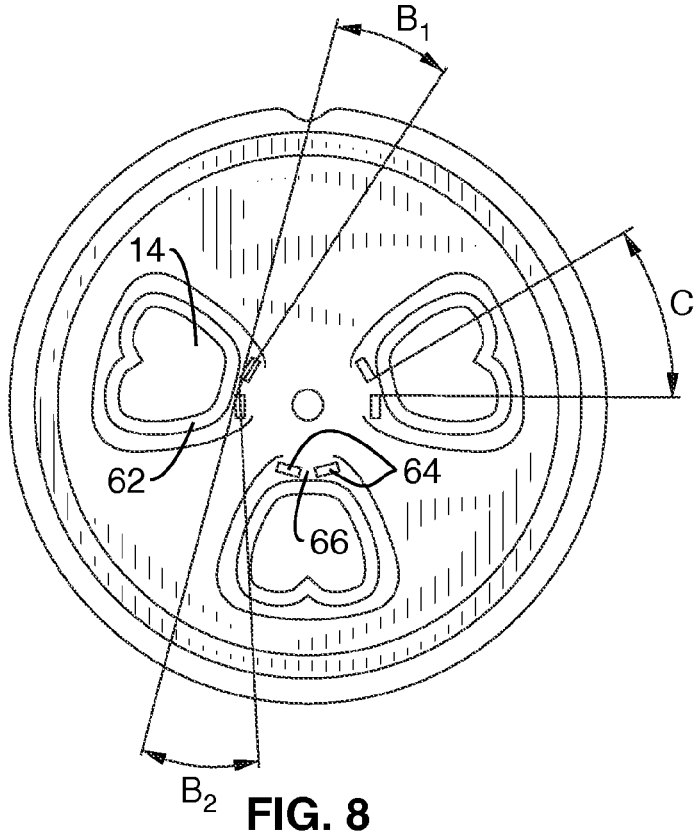
FIG. 8 is a top view of a container according to the present invention with the pull-tab removed, showing detail of the container leaves.

FIG. 8 shows details of the leaves 14 that aid in opening the container 10. The pull-tab 12 is not included in this figure to more clearly show the features of the leaves 14. Each leaf 14 has two raised impressions 64 on either side of a gap 66 located on the end of the leaf 14 that is closest to the rivet 20. Preferably, the raised impressions 64 are placed angles B1 and B2 relative to a tangent of the leaf 14 on which it is placed, as shown in FIG. 8. The angles B1 and B2 are each preferably, but not limited to, about 17.5°. The raised impressions 64 produce a gap 66 between them having an angle C, which is preferably, but not limited to, about 35°. It is easily seen that angle C is equal to the sum of angles B1 and B2. The angle C is preferably the same as angle A in FIG. 4.

The raised impressions 64 receive the locator tab 60 in the gap 66 to precisely locate the pull-tab 12 over the portion of the leaf 14 that results in efficient opening of the leaf 14. The locator tab 60 preferably exhibits the same angle as the gap 66 for the most secure and stable fit, but the angles may be different as long as the locator tab 60 can register with the raised impressions 64 and the gap 66 without slippage and as long as the junction of these elements allows the pull-tab 12 to effectively force open the leaves 14.

Figure 9:
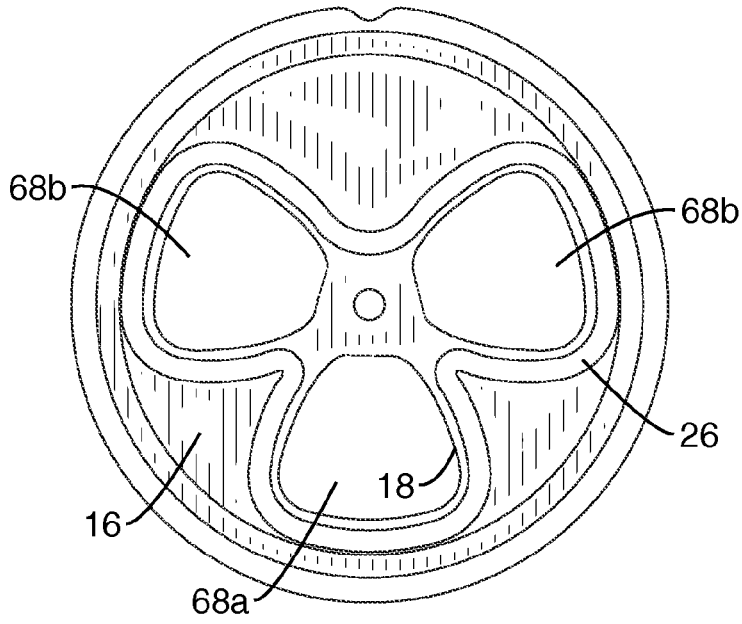
FIG. 9 is a top view of a container according to the present invention with the pull-tab removed, showing the openings without the container leaves present.

FIG. 9 shows an embodiment of the container 10 with leaves 14 removed to reveal center opening 68*a* and side openings 68*b*. Preferably, the center opening 68*a* is a "drink opening" and the side openings 68*b* are "aroma openings". The embodiments shown in the figures each contain two side openings 68*b*, but could include more or fewer than two openings without departing from the present invention. In this embodiment, the ridge 26 completely surrounds the openings 68*a*, 68*b* just outside of the edges (scorelines) 18, and provides structural stability for the top surface 16 when manipulating the pull-tab 12 to force open the leaves 14 of the container 10. The ridge 26 can also be used to exhibit a themed design that may be coordinated with the container's external decoration, with the design on a pull-tab 12, or both. The ridge 26 may not be present in all embodiments, may not entirely surround the openings 68*a*, 68*b*, and may be in a different location relative to the openings 68*a*, 68*b* than shown in FIG. 9. Preferably, the pull-tab 12 occupies no more than ten percent of the area of each opening 68*a*, 68*b* after the leaves 14 have been depressed.

Figure 10:
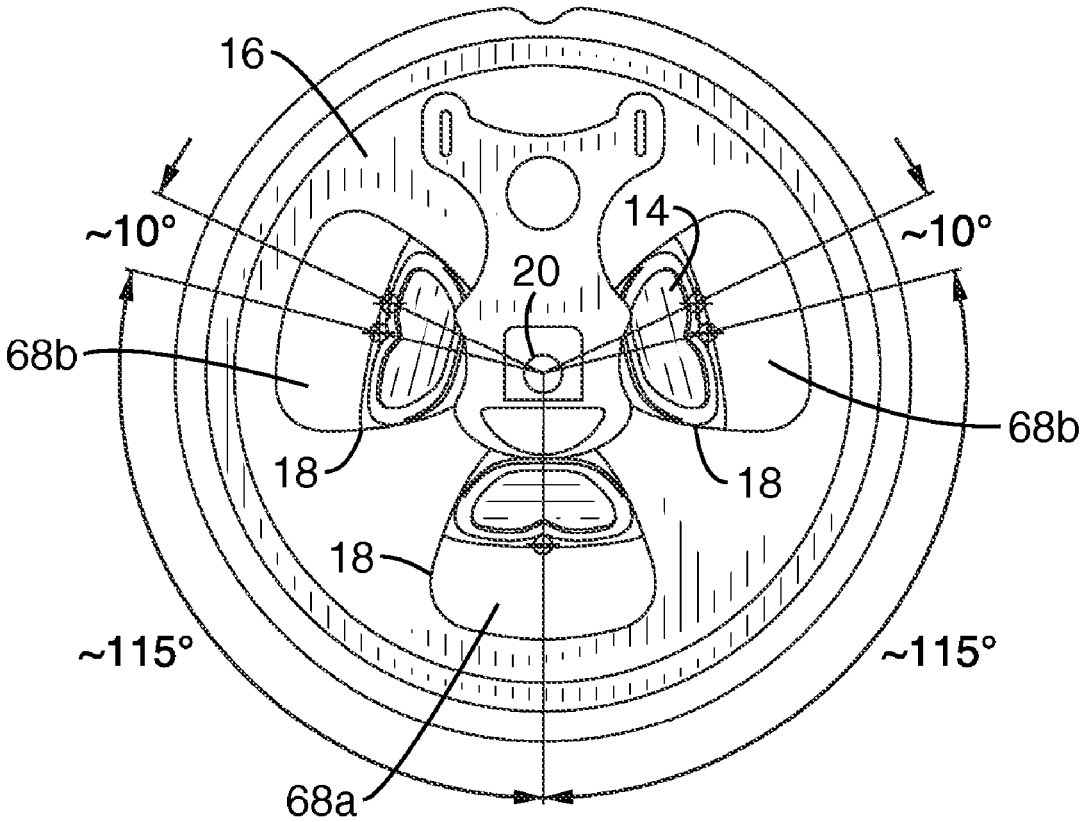
FIG. 10 is a top view of a container according to the present invention, with the pull-tab present and the container leaves opened.

FIG. 10 shows an embodiment of a container 10 with the pull-tab 12 present and the leaves 14 opened, but pushed into the interior of the container 10. The leaves 14 may be pushed even further into the container 10 than shown, if desired. The leaves 14, when pushed into the container 10, provide a surface that acts as a damper, or anti-sloshing mechanism for the liquid inside the container. In this embodiment, the pull-tab 12 pivots around the rivet 20 to access each of the leaves 14. For example, the finger-pull 22 is pulled up to open the center leaf, and the pull-tab 12 is then manipulated about the rivet 20 to access each of the side leaves using the finger rests 50.

The preferred orientation of the openings 68*a*, 68*b* is shown in FIG. 10. Using a line from the rivet 20 through the center point 70 of the center opening 68*a* as a guide, each side opening 68*b* is preferably located approximately 105° away, measured from the center point 70 of each side opening 68*b*. If the container 10 has two side openings 68*b*, they are preferably located in positions that are preferably mirror images of one another relative to the center opening 68*a*. Side openings 68*b* that are located approximately 105° from the center opening 68*a* were found to provide the optimal mix of airflow, aroma maximization, and stability for the liquid inside. The side openings 68*b* can be placed further away from the center opening 68*a*, but it is preferable that the side openings 68*b* be located no more than about 115° away. FIG. 10 indicates the hypothetical center point of an opening at the maximum preferred angle as well as at the angle shown. The spill resistance indicator 36 is preferably located on the container 10 to indicate the location of the center opening, to help a user to correctly position a container 10 before drinking or otherwise emptying the contents and avoid spillage.

Figure 11:
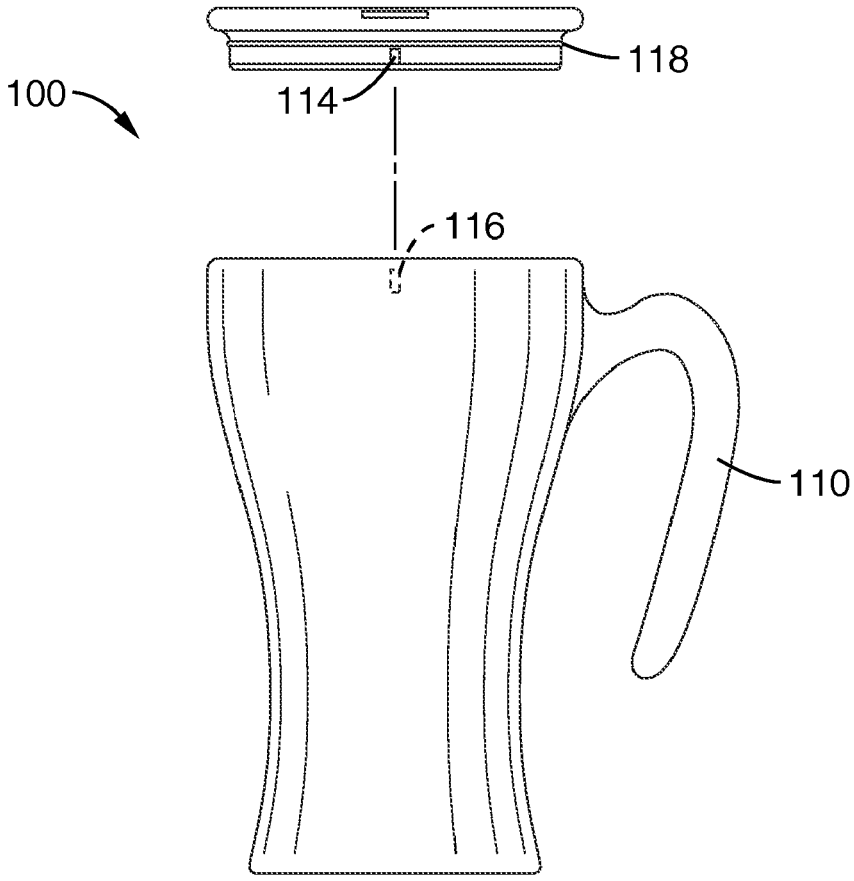
FIG. 11 shows an embodiment of a container having a removable top, according to an embodiment of the invention.
Figure 12:
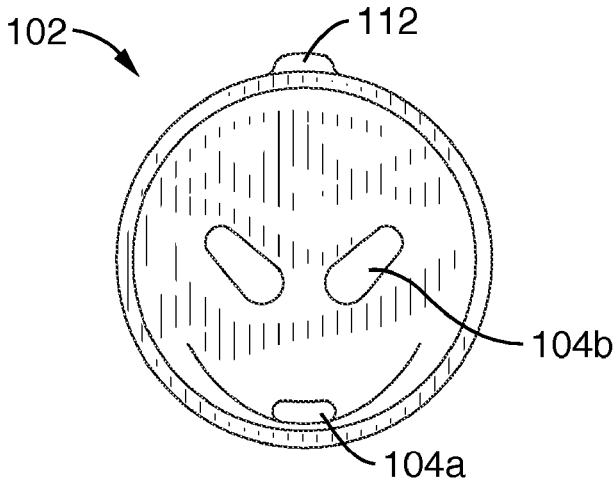
FIG. 12 is a top view of an embodiment of a removable top for the container shown in FIG. 11.
Figure 13:
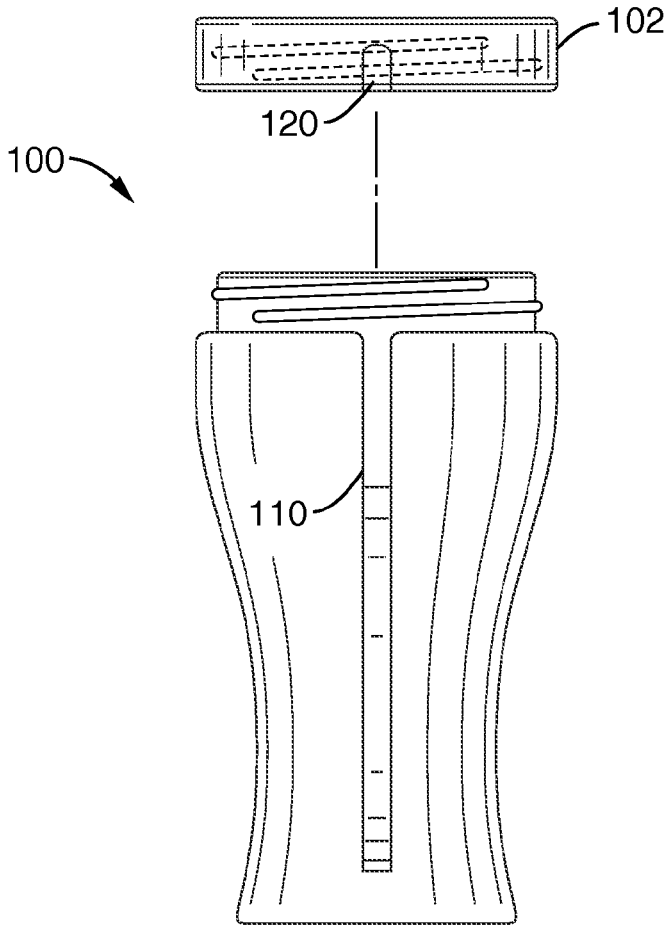
FIG. 13 shows an embodiment of a container having a removable top, according to an embodiment of the invention.
Figure 14:
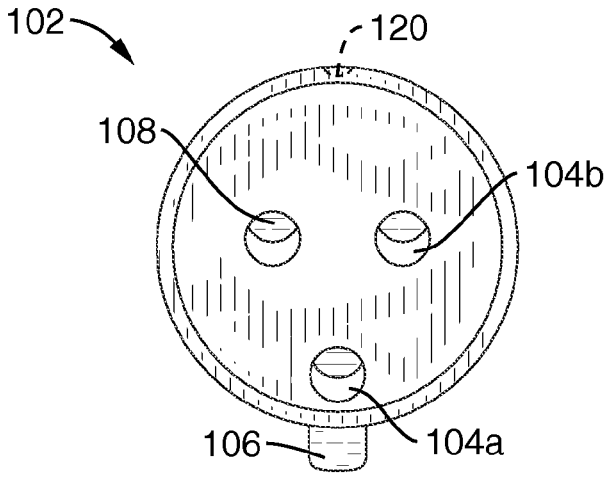
FIG. 14 is a top view of a removable top for the container shown in FIG. 13.

Other embodiments of the invention are shown in FIGS. 11-14, embodied as a travel container 100 having a removable cover 102. The cover 102 contains openings 104*a*, 104*b*, analogous to openings 68*a*, 68*b* in the container 10, that are shaped and oriented to maximize aroma and airflow characteristics, and may exhibit themed shapes if desired. An embodiment of the cover 102 in which a single aroma opening (not shown) is present, has a boomerang shape, which allows the nose to fully experience the aroma characteristics of the beverage within. The openings 104*a* and 104*b* can be fixed open, as shown in FIG. 12, or the travel container 100 may have an actuator 106, as shown in FIG. 14, to manipulate sections 108 included in the cover 102 to open or close the openings 104*a* and 104*b*. The actuator 106 can be embodied as a lever or a slider, or could be a spring-loaded push-button that snaps or clicks open. These sections 108 (shown in FIG. 14 as half-open) can slide either laterally or at a slight angle into the travel container 100, or the cover 102 could be configured to orient the sections 108 such that they point downwardly when opened and serve the same baffle function as the leaves 14 in their opened position. A spill resistance indicator 110 is present on the travel container 100 to indicate the proper orientation for drinking or otherwise emptying the contents without spillage. The spill resistance indicator 110 is shown as a handle in FIG. 11 and as a channel in FIG. 13, but may take any of several possible forms.

Other features can be present in the travel container 100 without departing from the present invention. The cover 102 can snap on to the travel container 100, as shown in FIG. 11, may have a tab 112 to aid in removal, or may include a protrusion 114 that mates with a groove 116 inside the travel container 100 to secure and orient the lid for right- or left-handed users. Preferably, two sets of protrusion 114 and groove 116 pairs are present on opposing sides of the travel container 100. The snap-on cover 102 may include an O-ring 118 for leakage prevention. Alternatively, the cover 102 may be threaded for secure attachment to the travel container 100, as shown in FIG. 13. A notch 120 is preferably present on the cover 102, designed to line up with the spill resistance indicator 110 when the cover 102 is tightened. In this way, a visual indication of the spill-resistance indicator 110 is present on the cover 102 for visual identification as well as on the side of the travel container 100 for tactile identification.

Containers may be of any size without departing from the present invention. For example, containers that are larger, smaller, or the same size as current standard aluminum soda cans or travel containers can be made according to the present invention. Containers exhibiting larger or smaller top surfaces can be made according to the present invention. The body shape of the container is unimportant, so long as it is configured to include the spill resistance indicator. The spill resistance indicator itself is not limited to the particular embodiments shown herein, but may exhibit a number of possible shapes and configurations, so long as it serves to indicate to a user the proper position for drinking or otherwise emptying the contents of the container. Finally, a container according to the present invention is not limited to having three openings, but may have any number of openings on the top surface of the container.

Advantages:

1. Sensory Experience

The containers of the present invention allow a user to enjoy the aroma of a beverage while drinking, by providing multiple openings that are preferentially located close to a user's nostrils during the act of drinking. In addition, the multiple openings allow carbonated beverages to directly stimulate the nose with that fizzy feeling. Due to the close relationship between the nasal experience (aroma and physical sensations) and taste, users will experience their favorite beverages differently. The inevitable result is enhanced and improved taste because the beverage is experienced on multiple sensory levels, rather than just one.

2. Stability

The ability of a liquid-filled container to resist splashing and sloshing, as well as spilling, is of paramount importance in the beverage industry. The baffle properties of the downwardly-oriented container leaves specifically improve splash and slosh resistance by dispersing the forces that cause it. The spill resistance indicator provides a visual and tactile indicator of the position of the openings, which aids a user in handling and moving the container without spilling its contents.

3. Airflow and Carbonation Duration

The additional openings in the containers of the present invention allow greater airflow in and out of the container, which, for a carbonated beverage, results in that beverage maintaining a high level of carbonation for a longer period of time. Each time a conventional container is tipped after it has been opened, turbulence is created from the necessity of replacing a volume of dispensed liquid with air. This turbulence causes the carbonated liquid to lose its carbonation relatively quickly, resulting in a "flat" beverage. The enhanced airflow provided by the additional openings means that less turbulence is caused to replace a displaced volume of liquid, and therefore, less carbonation is lost during drinking or movement. The containers of the present invention are also able to dispense a beverage more quickly, because the volume displacement occurs more quickly.

4. Comfort and User Friendliness

Some embodiments of the containers of the present invention include pull-tabs that are preferably designed with a user in mind, and have rolled or smooth edges and sturdy middle portions, and are oriented for easier finger ingress and manipulation. The spill resistance indicator also provides a benefit, allowing a user to dispense the contents of a container in low or no-light conditions without the danger of spillage.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A beverage container, comprising:

a plurality of scorelines defining a cloverleaf-shaped contour on an end of the beverage container;

wherein said scorelines outline three closed passages through said end; and a tab adjacent to and mounted above said scorelines, wherein a middle passage is located between two side passages, and wherein each said side passage is located about 105°-115° from said middle passage; and wherein said tab is manipulated to open said closed passages at said scorelines.

2. A container as recited in claim 1, further comprising:

a spill resistance indicator oriented between the ends of the container;

wherein said spill resistance indicator is parallel to a long axis of the container.

3. A container as recited in claim 1, further comprising:

a plurality of raised ridges about an outer perimeter of said scorelines.

4. A container as recited in claim 3:

wherein said raised ridges define a heart-shaped contour for each said passage.

5. A container as recited in claim 1:

wherein manipulation of said tab to open said closed passages creates a baffle inside the container; and wherein said baffle limits lateral movement of liquid inside the container.

6. A container as recited in claim 1, further comprising:

a guide region adjacent each of said passages at said scorelines and under said tab;

wherein said tab comprises a raised portion;

wherein said raised portion is oriented toward said end of the container; and wherein said raised portion registers with said guide region.

7. A container as recited in claim 6:

wherein each said guide region comprises a ridge having a gap.

8. A container as recited in claim 1:

wherein said tab comprises a customizable design portion.

9. A container as recited in claim 1:

wherein said tab covers no more than approximately ten percent of an area encompassed by each said passage.

10. A beverage container, comprising:

a can body with a top, said top having a plurality of scorelines defining a cloverleaf-shaped contour outlining three closed passages through said top;

a tab adjacent to and pivotally mounted above said scorelines; and tab guides on said top configured to register with said tab as an indicator of position upon axial rotation of the tab, wherein a middle passage is located between two side passages, and wherein each said side passage is located about 105°-115° from said middle passage; and wherein said tab is manipulated to open said closed passages at said scorelines.

11. A container as recited in claim 10, wherein manipulation of said tab to open said closed passages creates a baffle inside the container; and wherein said baffle limits lateral movement of liquid inside the container.

12. A container as recited in claim 10:

wherein each of said tab guides comprises a ridge having a gap; and wherein said tab has a locator tab configured to register with ridge.

13. A container as recited in claim 10, further comprising:

a spill resistance indicator oriented between the ends of the container;

wherein said spill resistance indicator is parallel to a long axis of the container.

* * * * *